US005448645A

United States Patent [19]

Guerci

[11] Patent Number: 5,448,645

[45] Date of Patent: Sep. 5, 1995

[54] ACTIVE FAN BLADE NOISE CANCELLATION SYSTEM

[75] Inventor: Joseph R. Guerci, Astoria, N.Y.

[73] Assignee: Raymond Guerci International, Inc., Staten Island, N.Y.

[21] Appl. No.: 203,339

[22] Filed: Feb. 28, 1994

[51] Int. Cl.[6] ..... G10K 11/16

[52] U.S. Cl. ..... 381/71

[58] Field of Search ..... 381/71, 94; 361/690–698

[56] References Cited

U.S. PATENT DOCUMENTS 4,122,303 10/1978 Chaplin et al. ..... 381/71

5,010,576 4/1991 Hill ..... 381/71

FOREIGN PATENT DOCUMENTS

WO0920179-36 10/1992 WIPO ..... 381/71

*Primary Examiner*—Edward L. Coles, Sr.

*Assistant Examiner*—Jerome Grant, II

[57] ABSTRACT

An active noise cancellation device and method for reducing fan blade noise over a broad spatial area. The device comprises a microphone, a band pass filter, and audio amplifier, and a speaker array. The microphone captures the sound produced by the fan and converts it into an electrical signal. This electrical signal is input to the band pass filter which has a center frequency equal to product of fan speed and the number of fan blades which comprise the fan. The band pass filter attenuates any signals other than the primary harmonic sound produced by the rotating fan blades. The filtered signal from the band pass filter is input to the audio amplifier. The audio amplifier conditions the signal for input to the speaker array. Accordingly, each speaker in the array receives and outputs an audio signal of equal amplitude and phase as that produced by the rotating fan blades. The speaker array is mounted on or close to the fan hub in a symmetric pattern commensurate with the fan blade geometry. In general, the number of speakers which comprise the array corresponds to the number of fan blades. The position of the speaker array is adjusted until a maximum destructive interference occurs between the sound produced by the rotating fan blades and the speaker array. With the addition of a phase shifter, the active noise cancellation device can be utilized to provide noise cancellation for variable speed fans.

21 Claims, 2 Drawing Sheets

ACTIVE FAN BLADE NOISE CANCELLATION SYSTEM

BACKGROUND OF THE INVENTION

1. Field of the Invention

The present invention relates to a sound dampening device and method, and more particularly, to an active noise cancellation device and method for reducing fan blade noise over a wide spatial area.

2. Discussion of the Prior Art

Noise, in general, can be defined as any sound that is undersired or interferes with one's hearing of something. It is well known that continued exposure to certain levels of noise can cause individuals varying levels of distress, ranging from minor discomfort to serious pain and permanent physical injury in the form of hearing loss. Prolonged exposure to noise levels below approximately seventy decibels is sustainable to the majority of individuals. Prolonged exposure to noise levels which are in the range of approximately seventy to ninety decibels typically causes individuals to experience irritation and stress. Sustained exposure to noise levels in the range of approximately ninety to one hundred twenty decibels can cause permanent hearing loss, and exposure to noise levels in excess of one hundred twenty decibels can reach the threshold of pain for the majority of individuals. Accordingly, when possible it is generally desirable to reduce noise levels as much as possible in a particular environment.

While exposure of limited duration to noise is part of the overall problem of noise pollution, environments where individuals are exposed to noise for extended periods, for example the work place, pose a more serious concern. The typical work place can be a factory with heavy machinery operation or a modern office with computers, word processors, and typewriters. Factories utilizing heavy machinery generate much higher levels of noise than modern offices; accordingly, much of the focus of noise reduction has centered on quieting factory type environments. However, although the noise levels in modern offices are much lower than in factories utilizing heavy machinery, the noise generated by office machines and computer work stations do present a definite noise problem.

One of the significant contributors to the noise problem in offices is fan noise. The majority of electrically powered machines utilized in offices require fans to supply air for cooling purposes. Computers and word processors all require fans to deliver cooling air to the electronics to prevent damage thereto. Other examples of devices utilizing fans are overhead projectors and photostatic copying machines. Therefore, in order to eliminate a significant contributor to the noise problem, in and out of the work place, some form of noise reduction is required to reduce fan noise.

The science of noise reduction can be divided into two broad categories, passive noise reduction and active noise reduction. Passive noise reduction involves the blocking of the compression waves generated by the noise source with a sound absorbing device. This technique is labeled as passive noise reduction because it does not require an external energy source to accomplish its task. Passive noise reduction techniques tend to be more effective for higher frequency noise than for lower frequency noise. There are many well known passive noise reduction devices, for example, automobile mufflers, acoustical wall and ceiling tiles, and a wide assortment of enclosure devices for noisy machines. Active noise reduction techniques, in contrast, refers to any electro-acoustical method in which an undesired sound wave is cancelled by a second sound wave that has the same spatial geometry amplitude and frequency, but is one hundred eighty degrees out of phase. Accordingly, an undesired sound can be cancelled by generating a second sound of the same amplitude and frequency, and adjusting its phase so that the peaks of one sound wave coincide with the valleys of the second wave thereby resulting in destructive interference. Active noise reduction techniques tend to be more effective in attenuating lower frequency noise and vibration. Accordingly, active and passive noise reduction techniques have been most effectively utilized in a complementary fashion to attenuate a variety of wideband noises.

There exists elaborate devices for active noise reduction as evidenced by an examination of the patent art. U.S. Pat. No. 5,224,168 to Martinez et al. discloses a method and apparatus for the active reduction of noise and other compression waves. The patented invention utilizes multi-channel noise reduction techniques in conjunction with signal processing techniques to achieve the desired results. The apparatus is a complex system comprising microphones, a multi-channel signal processor, speakers, and various filtering devices. Essentially, the apparatus operates by generating a number of compression signals from compression waves detected by the microphones at a number of locations within a particular medium. The compression signals are processed by the multi-channel signal processor in order to produce complementary compression waves which are then directed towards the noise through the speakers. Neutralization filters are utilized to compensate for the feedback which occurs when speakers and microphones are used in close proximity.

U.S. Pat. No. 5,140,640 to Graupe et al. discloses an apparatus for cancelling or substantially reducing the noise from a source. The patented invention is a self-adaptive noise cancellation system that is utilized in a noisy environment in proximity to the noise source to produce anti-noise signals that are directed to the noise and which counter the noise source. The system comprises a first microphone which captures the noise signal and directs the noise signal to a stochastic identifier circuit. The stochastic identifier circuit generates a set of stochastic parameters that characterize the noise signals from the source. The stochastic identifier circuit periodically updates these parameters to make the system adaptive and self-adjusting. A noise cancellation circuit generates an anti-noise signal or cancellation signal which is directed to a loudspeaker positioned in proximity to the noise source. The cancellation signal combines with the noise from the source to substantially reduce the noise level. The noise cancellation circuit receives a set of signals from the stochastic identifier circuit as one input and a set of signals from an amplifier circuit configured as a summing circuit as a second input and generates the cancellation signal therefrom. The amplifier circuit combines the signals captured by the first microphone and the signals captured by a second microphone positioned in proximity to the noise source. The second microphone is utilized to capture the anti-noise signal.

Each of the above two described inventions disclose devices and techniques for the effective reduction of noise created by a variety of sources, including the noise generated by the movement of fan blades through the air. However, the above-described inventions, like other commercially available active noise reduction devices, utilize digital signal processing techniques and complicated systems to reduce noise. Devices such as these which require relatively complicated electronics and digital signal processing are expensive and difficult to implement and this would not typically be utilized on smaller electrically powered, fan cooled machines. In addition, in order to achieve noise cancellation over a wide spatial area, cancellation should occur at the source.

SUMMARY OF THE INVENTION

The present invention is directed to a system and method for reducing fan blade noise. The system comprises four basic components, a sensor, a filter, an amplifier, and a speaker array. The sensor, which can be a microphone or other acoustic sensor, is positioned in proximity to the fan and senses the sound waves produced by the rotating fan blades. The sensor converts the sound waves into an electrical signal stream. This electrical signal stream is input to the filter for attenuation of extraneous signals. The filter is a band pass filter having a predetermined center frequency, which is calculated as a function of certain fan design parameters, thereby ensuring that only the primary harmonic sounds produced by the rotating fan blades are passed. The output of the filter is input to the amplifier. The amplifier is an audio amplifier which is utilized to adjust the amplitude of the input signal to match the amplitude of the sound waves produced by the rotating fan blades. The speaker array is connected to and receives input signals from the audio amplifier and converts the electrical signals therefrom back into audio signals. The speaker array is positioned in proximity to the fan blades such that the audio signals from the speaker array are out of phase with the sound waves produced by the rotating fan blades. This out of phase condition results in destructive interference between the two signals, and essentially the cancellation of both signals.

To achieve the proper destructive sound interference necessary for noise reduction, as described above, a simple calibration procedure is necessary. The first step in the calibration procedure is adjusting the volume of the audio amplifier so that the sound intensity output of the speaker array matches the sound intensity of the rotating fan blades. The volume can be adjusted by a sound measuring device such as a sound meter or spectrum analyzer, or by manual adjustment based upon the perception of the human ear. The second and final step in the calibration process is adjusting the phase of the sound waves produced by the speaker array by rotating the speaker array until maximum destructive interference occurs. The speaker array comprises at least a number of individual speaker elements equal to the number of fan blades comprising a particular fan. Each speaker element in the speaker array outputs identical sound waves, and thus it is possible to achieve the same spatial pressure field set up by the fan blades, but one hundred eighty degrees out of phase therewith. Once again, this can be accomplished by a sound measuring device as discussed above, or the perception of the human ear.

The system for reducing fan blade noise of the present invention can be utilized on any type of fixed speed fan regardless of fan blade geometry. The system, however, can also be utilized to provide noise cancellation for variable speed fans by including a phase shifter. The phase shifter receives two signals, the signal stream from the audio amplifier and the fan speed directly from the fan or from a tachometer measuring the fan speed. Accordingly, an appropriate phase shift versus frequency response can be performed which maintains the requisite phase shift required for noise cancellation.

The system for reducing fan blade noise of the present invention is a simple and inexpensive system for implementing an active noise cancellation technique that reduces noise over a wide spatial area. The system exploits the basics of wave mechanics to achieve a high level of noise reduction. The system comprises simple electronic components which are readily available, off the shelf items. Accordingly, the system is easy to repair if necessary, and easy to maintain. Given the simplicity of the system and its components, there is less of a chance of malfunction and therefore less system down time.

The system for reducing fan blade noise of the present invention is easily adaptable to virtually all existing fans and devices which utilize fans. The system can be mounted to existing devices without permanent modification to the devices and without degrading the performance or efficiency of the devices or the cooling capacity of the fans. Once installed, the system is simple to calibrate and operate. In addition, because of the systems low cost and ease of operation, the system can be installed on modestly priced devices.

DETAILED DESCRIPTION OF THE PREFERRED EMBODIMENTS

Figure 1:
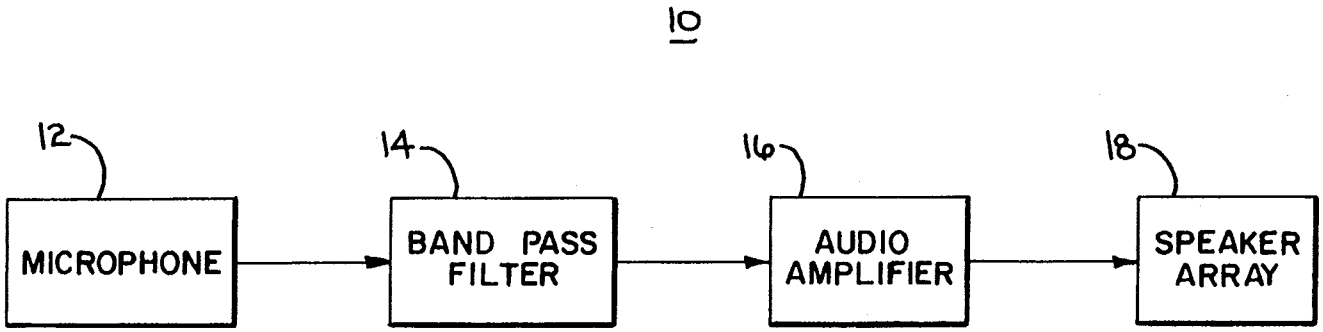
FIG. 1 is a block diagram representation of the active fan blade noise reduction system of the present invention.
Figure 2:
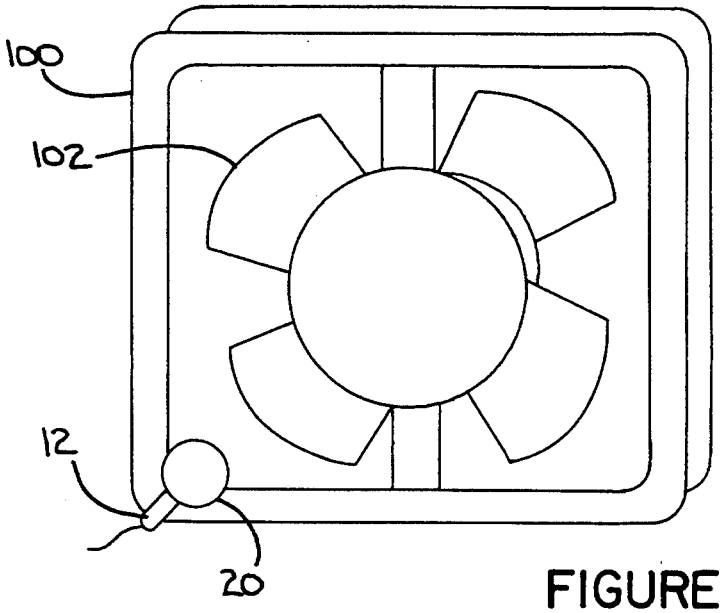
FIG. 2 is a diagrammatic representation of the positioning of the microphone of the active fan blade noise reduction system of the present invention on the fan assembly.

The active noise cancellation system of the present invention provides for the reduction of fan blade noise over a wide spatial area. Referring to FIG. 1, there is shown a block diagram representation of the active noise cancellation system 10. The active noise cancellation system 10 comprises a microphone 12, a band pass filter 14, an audio amplifier 16, and a speaker array 18. The microphone 12 is utilized to sense the sound waves generated by the rotation of the fan blades. Note, however, that other acoustic sensors can be utilized in place of the microphone 12. Essentially, the rotating fan blades create a disturbance in the air as they rotate. This disturbance is a series of compression waves or sound waves that propagate through the air. Depending upon fan speed and fan blade geometry, the sound created by this rotation can reach seventy decibels and above. Accordingly, this sound can be a nuisance. The microphone 12 is positioned in proximity to the outer edge of the fan blades in order to capture the sound waves produced by the rotation of the fan blades. FIG. 2 illustrates the positioning of the microphone 12 in proximity to the fan blades 102 of the fan 100. The microphone 12 can be fixed to the fan 100 or mounted on a stand near the fan 100. The microphone 12 is covered with a wind screen 20 to prevent damage to the microphone 12. The wind screen 20 also serves as a filtering device by tending to reduce wind disturbances in proximity to the microphone 12. These wind disturbances typically cause the hissing sounds in amplification systems. The microphone 12 can be placed on either the output side of the fan 100 or the suction side of the fan 100 to sense the sound waves.

The microphone 12 converts the sensed sound waves into an electrical signal stream corresponding directly to the sensed sound waves produced by the rotation of the fan blades 102. This electrical signal stream from the microphone 12 is input into the band pass filter 14, as is shown in FIG. 1. The band pass filter 14 is designed with a center frequency given by $$f_c = \text{number of fan blades} * \text{fan speed},$$

wherein the fan speed is in cycles/second. For example, for a fan operating at 60 cycles/second and having five fan blades, the band pair filter 14 would have a center frequency of 300 Hertz. Accordingly, since the number of fan blades can vary from fan to fan, as well as the fan speed, the band pass filter 14 is designed to have an adjustable center frequency. The center frequency of the band pass filter 14 is easily adjustable by utilizing a potentiometer to vary the resistance of the circuit. The fan speed can also vary even though standard U.S. power is delivered at 60 cycles/second. The band pass filter 14 is utilized to attenuate extraneous signals from the signal of interest. The signal of interest in the present invention is the sound waves generated by the rotating fan blades 102. All other background noise and clutter is rejected by the band pass filter 14. The band pass filter 14 is designed to pass the primary harmonic sounds produced by the rotating fan blades 102. The primary harmonic is the major contributor to the noise by at least an order of magnitude. Therefore, by only utilizing the primary harmonic, the noise can be reduced and the system remains a simple device. The need for the band pass filter 14 is more fully explained subsequently.

The filtered signal stream output from the band pass filter 14 is input into the audio amplifier 16. The audio amplifier 16 adjusts the intensity of the amplitude of the signal stream output from the band pass filter 14 to a level commensurate with that of the sound waves produced by the rotating fan blades 102 shown in FIG. 2. Basically, the volume of the output signals from the audio amplifier 16 is adjusted such that the sound intensity of the acoustic signals output by the speaker array 18 matches that of the sound waves produced by the rotating fan blades 102. Adjustment of the audio amplifier 16 can be accomplished by means of a sound measuring device such as a spectrum analyzer or a sound meter or by the perception of the human ear.

Figure 3:
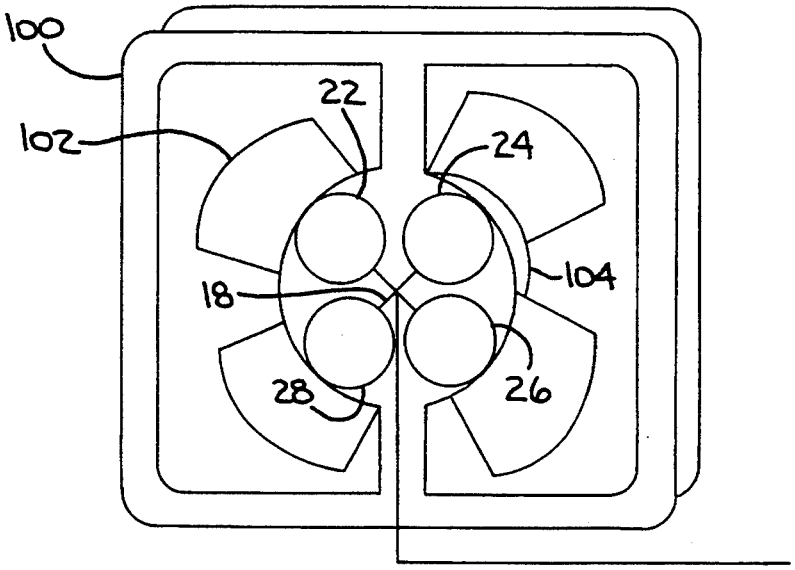
FIG. 3 is a diagrammatic representation of the positioning of the speaker array of the active fan blade noise reduction system of the present invention on the fan assembly.

The adjusted output of the audio amplifier 16 is input to the speaker array 18. The diagram of FIG. 3 illustrates the positioning of the speaker array 18 in proximity to the fan blades 102 of the fan 100. The speaker array 18 is mounted on or near the hub 104 of the fan 100. As is shown in the figure, the speaker array 18 has a diameter equal to the diameter of the hub 104. It is necessary that the speaker array 18 be equal to, or smaller than the hub 104 of the fan 100 to ensure that the speaker array 18 does not interfere with the air flow created by the fan 100. Interference with air flow diminishes the cooling capacity of the fan 100 and generates additional noise. However, the speaker array 18 can be designed in a manner such that it can be positioned outside the outer diameter of the fan blades 102. This configuration is generally less desirable because it requires additional space. As is the case with the microphone 12, the speaker array 18 can be placed on either side of the fan 100. However, it is important to isolate the speaker array 18 from the microphone 12. The isolation is necessary in order to preclude acoustic feedback signals. The speaker array 18 can be positioned on the same side of the fan 100 as the microphone 12 provided some form of electrical isolation is provided or space isolation is provided. The electrical isolation can be achieved with the addition of filters, while the space isolation can be achieved by positioning the speaker array 18 at the outer edge of the fan blades 102 as discussed above.

The speaker array 18 comprises a symmetrical arrangement of individual speaker elements. The number of individual speaker elements must at least be equal to the number of fan blades which comprise a particular fan. The speaker array 18 illustrated in FIG. 3 comprises four individual speaker elements 22, 24, 26 and 28 which corresponds to the number of fan blades 102 comprising the fan 100. The symmetrical pattern of individual speaker elements 22, 24, 26 and 28 is also necessary in order to generate a particular spatial pressure field. Each individual speaker element 22, 24, 26 and 28 transmits exactly the same sound signals, in both amplitude and phase. Accordingly, the sound pattern or spatial pressure field created by the speaker array 18 will closely approximate the spatial pressure field created by the rotating fan blades 102. Given the band pass filter 14 attenuates extraneous noise and the audio amplifier 16 adjusts the amplitude of the signal output therefrom to match the sound waves produced by the rotating fan blades 102, then the spatial pressure field created by the symmetrical arrangement must closely approximate that produced by the rotating fan blades. As dictated by the physics of wave mechanics, propogating waves can interfere with each other, thereby resulting in waves of diminished amplitude or the complete destruction of both waves. In any noise reduction technique, it is desirable to have the complete destruction of the sound waves. Therefore, in order to achieve the proper destructive interference necessary for noise reduction or elimination in the present invention, the phase of the sound waves produced by the speaker array 18 must be 180 degrees out of phase with the sound waves produced by the rotating fan blades. The phase of the sound waves produced by the speaker array 18 is easily adjusted by rotating the speaker array 18 until the maximum destructive interference occurs. The adjustment can be accomplished utilizing a sound measuring device as previously described or by the perception of the human ear. Once the proper phase orientation is achieved, destructive interference between the spatial pressure fields will result in the elimination of the noise created by the rotating fan blades 102. In other words, one sound completely cancels the other.

As stated above, the minimum number of individual speaker elements in the speaker array 18 must equal the number of fan blades 102; however, more speaker elements can be utilized as long as the symmetrical arrangement is maintained. For example, an eight speaker array can be utilized with a fan having four blades. The speakers must be arranged symmetrically with adjacent speakers being 180 degrees out of phase. Adjusting the phase of alternate adjacent speakers is accomplished by alternating the polarity of the speakers.

Figure 4:
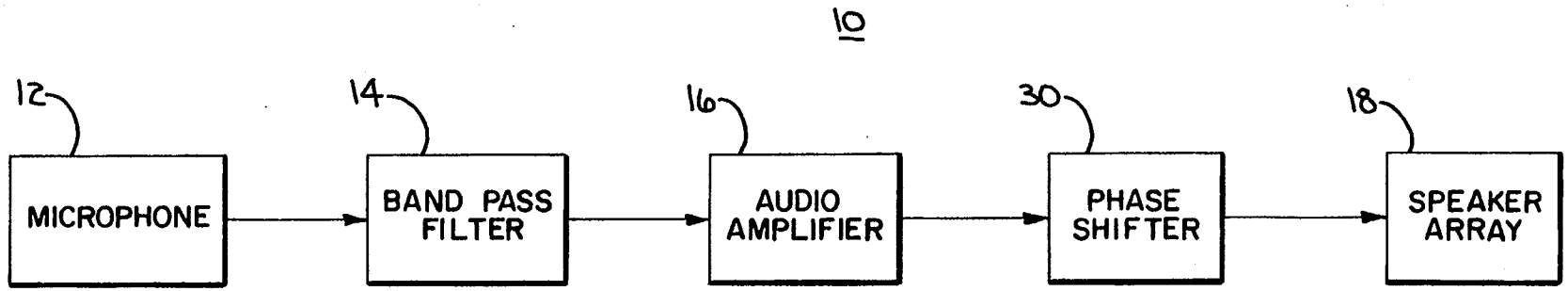
FIG. 4 is a block diagram representation of the active fan blade noise reduction system of the present invention employing a phase shifting device.

Referring to FIG. 4, there is shown an alternate design for the active noise cancellation system. A phase shifter 30 is added to accommodate variable speed fans. The phase shifter 30 is connected between the speaker array 18 and the audio amplifier 16. The phase shifter 30 receives two inputs, the output signal stream from the audio amplifier 16, and the fan speed. The phase shifter 30 utilizes these two inputs to generate an appropriate phase shift versus frequency response which functions to maintain the requisite 180 degree phase shift required for proper noise cancellation. The fan speed can be directly input to the phase shifter 30 from the fan 100 or from a tachometer connected to the fan 100. The phase shifter 30 can be as simple as an RC circuit, and if the fan has low, medium and high settings for fan speed, the phase shifter 30 would comprise three fixed RC circuits.

Although shown and described is what are believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

What is claimed is:

1. A system for reducing fan blade noise, said system comprising:

(a) sensor means for sensing the sound waves produced by rotating fan blades and converting said sound waves into an electrical signal stream, said sensor means being positioned in proximity to the blades of said fan;

(b) filter means adapted to receive said electrical signal stream from said sensor means as input, said filter means attenuating extraneous signals from said electrical signal stream and outputting a filtered signal stream;

(c) amplifier means connected to said filter means for adjusting the amplitude of said filtered signal stream to coincide with the amplitude of the sound waves produced by said rotating fan blades; and (d) a speaker array connected to said amplifier means for converting an output signal stream from said amplifier means into audio signals, said speaker array being positioned in proximity to said fan blades such that said audio signals are out of phase with said sound waves, thereby resulting in destructive interference, said speaker array comprises at least a number of individual speaker elements equal to the number of fan blades comprising said fan, wherein said individual speaker elements are arranged in a symmetrical pattern and each outputs said audio signals at the identical amplitude and phase thereby producing a spatial pressure field identical to the spatial pressure field created by said rotating fan blades.

2. The system for reducing fan blade noise according to claim 1, further comprising a phase shifting means for adjusting the phase of said output signal stream from said amplifier means to compensate for variable fan speeds.

3. The system for reducing fan blade noise according to claim 2, wherein said sensor means is a microphone, said microphone being positioned in proximity to the outer edge of said fan blades.

4. The system for reducing fan blade noise according to claim 3, wherein said microphone comprises a windscreen to prevent damage to said microphone and to reduce wind noise.

5. The system for reducing fan blade noise according to claim 4, wherein said filter means is a band pass filter having a center frequency equal to the product of the fan speed and the number of fan blades which comprise said fan.

6. The system for reducing fan blade noise according to claim 5, wherein said amplifier means is an audio amplifier.

7. The systems for reducing fan blade noise according to claim 1, wherein the diameter of said speaker array is less than or equal to a hub of said fan.

8. The system for reducing fan blade noise according to claim 1, wherein the diameter of said speaker array is greater than the diameter of rotation of said fan blades.

9. An active noise cancellation system for reducing fan blade noise over a wide spatial area, said system comprising:

(a) sensor means for sensing the sound waves produced by rotating fan blades and converting said sound waves into an electrical signal stream, said sensor means being positioned in proximity to the blades of said fan;

(b) filter means adapted to receive said electrical signal stream from said sensor means as input, said filter means attenuating extraneous signals from said electrical signal stream and outputting a filtered signal stream;

(c) amplifier means connected to said filter means for ajdusting the amplitude of said filtered signal stream to coincide with the amplitude of the sound waves produced by said rotating fan blades; and (d) a speaker array connected to said amplifier means for converting an output signal stream from said amplifier means into audio signals, said speaker array being positioned in proximity to said fan blades such that said audio signals are out of phase with said sound waves, thereby resulting in destructive interference; and (e) phase shifting means for adjusting the phase of said output signal stream form said amplifier means to compensate for variable fan speeds.

10. The active noise cancellation system for reducing fan blade noise according to claim 9, wherein said sensor means is a microphone, said microphone being positioned in proximity to the outer edge of said fan blades.

11. The active noise cancellation system for reducing fan blade noise according to claim 10, wherein said microphone comprises a windscreen to prevent damage to said microphone and to reduce wind noise.

12. The active noise cancellation system for reducing fan blade noise according to claim 11, wherein said filter means is a band pass filter having a center frequency equal to the product of the fan speed and the number of fan blades which comprise said fan.

13. The active noise cancellation system for reducing fan blade noise according to claim 12, wherein said amplifier means is an audio amplifier.

14. The active noise cancellation system for reducing fan blade noise according to claim 13, wherein said speaker array comprises at least a number of individual speaker elements equal to the number of fan blades comprising said fan.

15. The active noise cancellation system for reducing fan blade noise according to claim 14, wherein said individual speaker elements are arranged in a symmetrical pattern and each output said audio signals at the identical amplitude and phase thereby producing a spatial pressure field identical to the spatial pressure field created by said rotating fan blades.

16. The active noise cancellation system for reducing fan blade noise according to claim 15, wherein the diameter of said speaker array is less than or equal to a hub of said fan.

17. The active noise cancellation system for reducing fan blade noise according to claim 15, wherein the diameter of said speaker array is greater than the diameter of rotation of said fan blades.

18. An active noise cancellation method for reducing fan blade noise over a wide spatial area, said method comprising the steps of:

(a) sensing the sound waves produced by said fan blades as they rotate and converting them into a signal stream;

(b) filtering said first signal stream to attenuate extraneous signals from said signal stream;

(c) adjusting the amplitude of said signal stream to coincide with the amplitude of the sound waves produced by said rotating fan blades;

(d) generating an audio signal stream from said signal stream in proximity to said fan blades; and (e) adjusting the phase of said audio signal stream until maximum destructive interference results between said audio signal stream and said sound waves.

19. The active noise cancellation method according to claim 18, wherein said step of filtering comprises passing said signal stream through a band pass filter having a center frequency equal to the product of the fan speed and the number of fan blades which comprise said fan.

20. The active noise cancellation method according to claim 19, wherein said step of generating an audio signal stream comprises utilizing a symmetrical speaker array having at least a number of individual speaker elements equal to the number of fan blades to generate a spatial pressure field equal to that generated by said rotating fan blades.

21. The active noise cancellation method according to claim 20, wherein said step of adjusting the phase comprises positioning said symmetrical speaker array such that said spatial pressure field is one hundred eighty degrees out of phase with that produced by said rotating fan blades.

* * * * *